US005440853A

United States Patent [19]

Engdahl

[11] Patent Number: 5,440,853

[45] Date of Patent: Aug. 15, 1995

[54] ROLLER COVER STORING METHOD

[75] Inventor: David C. Engdahl, Manassas, Va.

[73] Assignee: Stephanie L. Engdahl, Manassas, Va.

[21] Appl. No.: 323,121

[22] Filed: Oct. 14, 1994

[51] Int. Cl.[6] ..... B67B 1/04; B67B 5/04; B67B 7/28; B67B 31/00

[52] U.S. Cl. ..... 53/432; 53/471; 53/486; 53/489

[58] Field of Search ..... 53/431, 471, 468, 492, 53/474, 489, 432, 433, 486, 289, 320; 206/209, 209.1, 361, 81, 1.8, 1.9

[56] References Cited

U.S. PATENT DOCUMENTS

| | | | |
|---|---|---|---|
| 3,103,089 | 9/1963 | Allen | 53/289 X |
| 3,457,694 | 7/1969 | Tatibana | 53/289 UX |
| 3,491,803 | 1/1970 | Galik | 53/289 UX |
| 3,577,698 | 5/1971 | Ruekberg | 53/471 |
| 3,590,557 | 7/1971 | Vogel | 53/289 UX |
| 3,748,209 | 7/1973 | Pearson et al. | 53/289 X |
| 3,918,582 | 11/1975 | Wallace | 206/209 X |
| 3,945,174 | 3/1976 | Franz | 53/289 |
| 3,955,670 | 5/1976 | Buslik | 206/209 X |
| 3,973,603 | 8/1976 | Franz | 53/289 UX |
| 4,338,765 | 7/1982 | Ohmori et al. | 53/486 X |
| 4,467,533 | 8/1984 | Sica | 206/361 X |
| 4,738,358 | 4/1988 | Kehl | 206/361 X |
| 4,802,576 | 2/1989 | Kern | 206/361 X |
| 4,982,471 | 1/1991 | Bannan | 206/361 X |
| 4,982,838 | 1/1991 | Fitjer | 206/209 |
| 5,032,188 | 7/1991 | Kettle et al. | 206/361 X |
| 5,074,098 | 12/1991 | Filipchuk | 53/471 X |
| 5,178,274 | 1/1993 | Long | 206/361 |
| 5,244,090 | 9/1993 | Keith | 206/361 |

*Primary Examiner*—Horace M. Culver
*Attorney, Agent, or Firm*—Walter F. Wessendorf, Jr.

[57] ABSTRACT

Method of storing a wet-paint roller cover within a cylindrical tube having open distal and proximal ends; and sealing the open distal and proximal ends of the cylindrical tube by respective distal and proximal end caps.

2 Claims, 1 Drawing Sheet

ROLLER COVER STORING METHOD

BACKGROUND

1. Technical Field

This invention relates to a roller cover storing method.

2. After a roller cover has been utilized to apply paint, it must be thoroughly cleaned immediately for effective future use. If it is not thoroughly cleaned immediately, the paint retained by the roller cover will "set-up" and then harden, rendering the roller cover useless. Sometimes after a paint roller is employed, an unsuccessful attempt is made to roll out the paint from the roller cover so that the roller cover can be used again the next day. "Unsuccessful" because, if the roller cover has not been thoroughly cleaned, re-use of the same roller cover will result in the paint not being applied uniformly. Sometimes, a number of rooms are to be painted the same color, requiring several days. Sometimes, a painting job requires paint-roller application of a first coat, a second coat of the same color paint the next day, and, depending upon coverage, a third coat of the same color paint the third day.

SUMMARY OF THE INVENTION

This invention, by its method of storing a roller cover, contributes to the solutions of the discussed problems of the prior art by fully inserting a wet-paint roller cover within a cylindrical tube whose open distal end is sealed by a removable distal end cap, and then simply sealing the open proximal end of the cylindrical tube with a removable proximal end cap. By this method, the sealed roller cover can be kept up to six months without the wet paint retained by the roller cover "setting-up" and hardening. Hence, the same roller cover can be used to apply the same color paint again, or the same roller cover can be thoroughly cleaned to apply a different color paint.

BRIEF DESCRIPTION OF THE DRAWING

The method of this invention should be discerned and appreciated by reference to the perspective view, taken in conjunction with the "DETAILED DESCRIPTION OF THE PREFERRED METHOD".

DETAILED DESCRIPTION OF THE PREFERRED METHOD

Figure 1:
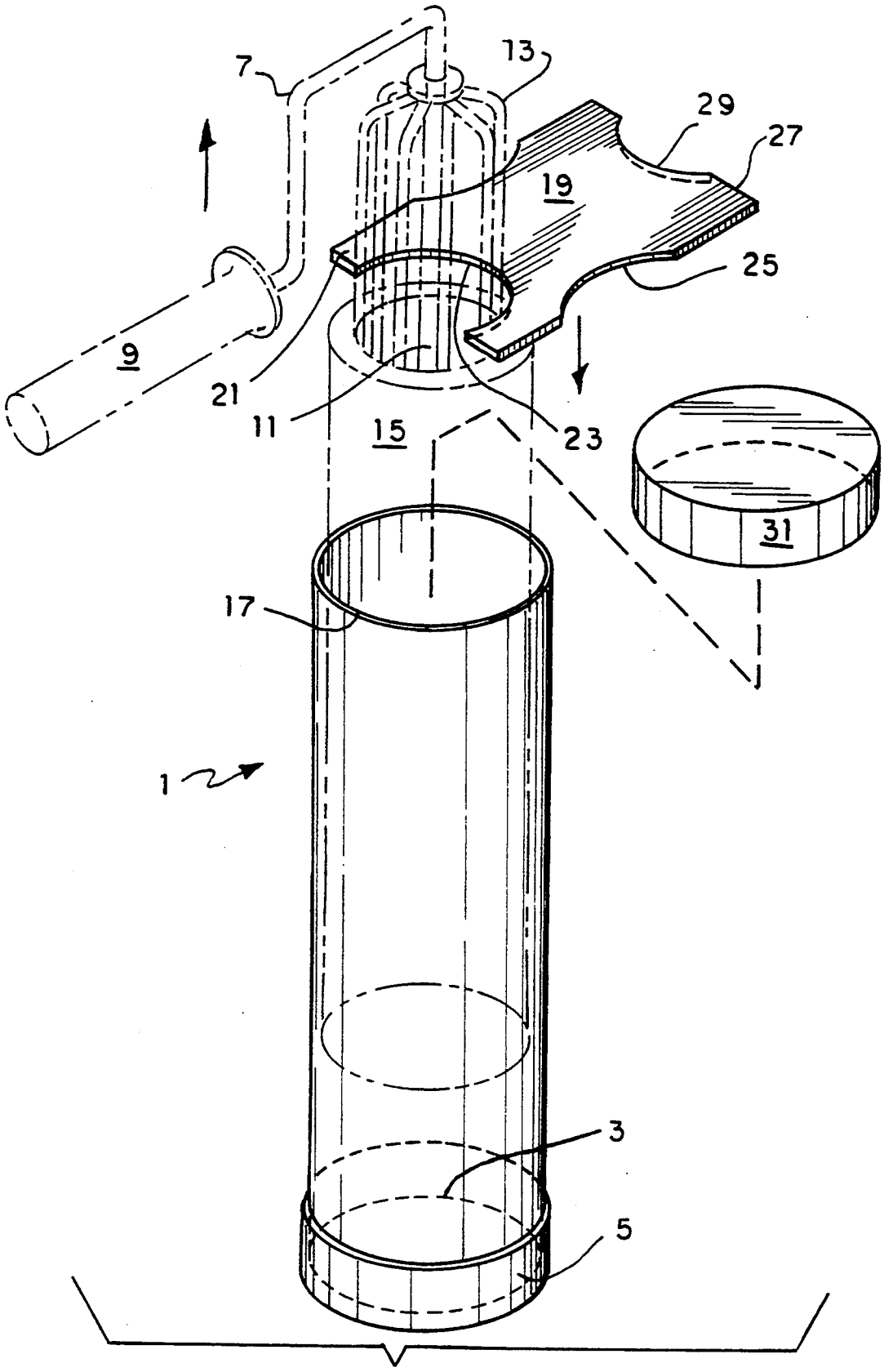

Reference numeral 1 generally refers to a plastic cylindrical tube whose open distal end 3 is closed and sealed by a plastic distal end cap 3 in interference fit therewith. Shown in phantom lines is a conventional roller frame 7 having a handle 9 whose depending rod 11 freely mounts for rotation a cage 13 of longitudinal spring elements. Shown in phantom lines is a conventional roller cover 15 which comprises a comparatively rigid inner circular sleeve or core, which fixedly carries an outer fuzzy sleeve of napped fabric to retain paint for its application. Upon inserting the cage 13 within the circular core of the roller cover 15, the cage's longitudinal spring elements are depressed and relieved to removably retain the roller cover 15 thereby. The combination of the roller frame 7 with the roller cover 15 emplaced thereon is referred to as a "paint roller". For purposes of illustrative discernment, the roller cover 15 is depicted as being partially inserted within the cylindrical tube 1 and the cage 13 is depicted as being partially inserted within the roller cover 15. In practicing the method of this invention, a painter would grasp, with one hand, the handle 9 of the roller frame 7 whose cage 13 is fully inserted within the open circular core of the roller cover 15; and then he would appropriately insert the wet-paint roller cover 15 through the open proximal end 17 of the cylindrical tube 1. For purposes of further convenience in practicing the method, a combination flat-metal tool 19 is provided to facilitate maintaining the roller cover 15 fully inserted within the cylindrical tube 1 while removing the cage 13 from the open core of the roller cover 15. Distally, the tool 19 defines two projecting prongs 21 and, therebetween, a scalloped-out portion 23 whose periphery defines and subtends the length of a circular arc of more than 270°. Laterally, the tool has two opposed scalloped-out portions 25 to facilitate manually grasping the tool 19 thereby. Proximally, the tool 19 has two projecting prongs 27 and a scalloped-out portion 29 therebetween. The two lateral prongs 27, together with the intermediate scalloped-out portion 29, is employed by inserting the lateral prongs 27 between the grooved top of a conventional paint can and its top lid to facilitate removal of the top lid to open the paint can. The radii of the scalloped-out portion 23 and the open circular core of the roller cover 15 are approximately the same. With his one hand grasping the handle 9 of the roller frame 7 and with his other hand grasping the scalloped-out portions 25, the painter appropriately applies the tool 19 distally and downwardly such that the scalloped-out portion 23 mates with the open circular core of the roller cover 15 and engages the common lateral side at the proximal end of such open circular core to thereby maintain the roller cover 15 fully inserted within the cylindrical tube 1. Then, the painter simultaneously lifts up the handle 9 with his one hand and pushes down on the tool 19 with his other hand to fully remove the cage 13 from the core of the roller cover 15. Then, the painter, with his one hand cradling the cylindrical tube 1 toward its distal region, and with his other hand appropriately emplacing the plastic proximal end cap 31 upon the open proximal end 17 of the cylindrical tube 1; the painter would simultaneously squeeze the cylindrical tube 1 with his one hand while forcing with his other hand the proximal end cap 31 in the direction towards the distal end cap 5, and release his one hand from the cylindrical tube 1. Such manual squeezing action creates a partial vacuum within the cylindrical tube 1, with manual release from such squeezing action drawing the proximal end cap 31 slightly inward to seal the open proximal end 17 of the cylindrical tube 1. To break the seals of the end caps 5 and 31, the painter simply cradles the cylindrical tube I with both hands and squeezes the cylindrical tube 1.

I claim:

1. A method of storing a wet, paint-roller cover for up to six months and without wet paint retained by the roller cover setting-up and hardening, the method comprising the steps of: providing an elongated plastic cylindrical tube having proximal and distal open ends, and providing removable proximal and distal end caps for interference fit with the respective proximal and distal ends of the cylindrical tube for closing and sealing the respective proximal and distal open ends of the cylindrical tube, closing by a human operator of the distal open end of the cylindrical tube by his emplacing the distal end cap thereon, inserting by the human operator of the wet, paint-roller cover fully within the cylindrical tube, cradling, by the human operator with his one hand, the cylindrical tube in the region of its distal end, and with his other hand emplacing the proximal end cap upon the proximal open end of the cylindrical tube, squeezing of the cylindrical tube by the human operator with his one hand while simultaneously forcing, with his other hand, the proximal end cap distally, and then releasing his squeezing hand from the cylindrical tube to create a partial vacuum within the cylindrical tube to thereby draw the proximal end cap further distally to thereby seal the proximal open end of the cylindrical tube.

2. The method according to claim 1 wherein the human operator can break the seals provided by the proximal and distal end caps to open the end caps to retrieve the wet, paint-roller cover from the cylindrical tube by the additional steps of cradling the cylindrical tube with his hands and squeezing the cylindrical tube with his hands.

* * * * *